US010760850B2

(12) United States Patent
Kennedy et al.

(10) Patent No.: US 10,760,850 B2
(45) Date of Patent: Sep. 1, 2020

(54) GAS LIQUEFACTION SYSTEMS AND METHODS

(71) Applicant: GE Oil & Gas, Inc., Houston, TX (US)

(72) Inventors: David Allen Kennedy, New Braunfels, TX (US); John Raymond Zigtema, San Antonio, TX (US); Deanna Koreen Hamm, Nixon, TX (US)

(73) Assignee: GE OIL & GAS, INC, Houston, TX (US)

( * ) Notice: Subject to any disclaimer, the term of this patent is extended or adjusted under 35 U.S.C. 154(b) by 9 days.

(21) Appl. No.: 15/356,591

(22) Filed: Nov. 20, 2016

(65) Prior Publication Data

US 2017/0227283 A1 Aug. 10, 2017

Related U.S. Application Data

(60) Provisional application No. 62/291,868, filed on Feb. 5, 2016.

(51) Int. Cl.

| | |
|---|---|
| ***F25B 1/02*** | (2006.01) |
| ***F25J 1/00*** | (2006.01) |
| ***F25J 1/02*** | (2006.01) |

(52) U.S. Cl.

CPC ..... *F25J 1/0022* (2013.01); *F25J 1/004* (2013.01); *F25J 1/0025* (2013.01); *F25J 1/0035* (2013.01);

(Continued)

(58) Field of Classification Search

CPC ..... F25J 1/0032; F25J 2230/60; F25J 1/0022; F25J 1/0025; F25J 1/0035; F25J 1/004;

(Continued)

(56) References Cited

U.S. PATENT DOCUMENTS

| | | | |
|---|---|---|---|
| 3,677,019 | A | 7/1972 | Olszewski |
| 4,040,806 | A | 8/1977 | Kennedy |

(Continued)

FOREIGN PATENT DOCUMENTS

| | | | |
|---|---|---|---|
| JP | H05-203342 | A | 8/1993 |
| WO | 2007/142668 | A1 | 12/2007 |

OTHER PUBLICATIONS

Remeljej, C.W., et al., "An exergy analysis of small-scale liquefied natural gas (LNG) liquefaction processes," Energy, vol. 31, No. 12, pp. 2005-2019 (Oct. 20, 2004).

(Continued)

*Primary Examiner* — Brian M King

(74) *Attorney, Agent, or Firm* — Baker Hughes Patent Organization

(57) ABSTRACT

A liquefaction system that is configured to use a single methane expander to provide primary refrigeration duty. The liquefaction system can include a first or main heat exchanger and a fluid circuit coupled with the heat exchanger, the fluid circuit configured to circulate a process stream derived from an incoming feedstock of natural gas. The fluid circuit can comprise a compression circuit, methane expander coupled with the compression circuit and the main heat exchanger, a sub-cooling unit coupled with the methane expander, the sub-cooling unit configured to form a liquid natural gas (LNG) product from the process stream, and a first throttling device interposed between the main heat exchanger and the sub-cooling unit. The first throttling device can be configured to expand the process stream to a process pressure that corresponds with the suction pressure internal to the compression circuit.

5 Claims, 7 Drawing Sheets

(52) U.S. Cl.
CPC ..... *F25J 1/0037* (2013.01); *F25J 1/0045* (2013.01); *F25J 1/0202* (2013.01); *F25J 1/0231* (2013.01); *F25J 2205/02* (2013.01); *F25J 2210/90* (2013.01); *F25J 2215/60* (2013.01); *F25J 2220/64* (2013.01); *F25J 2230/60* (2013.01); *F25J 2240/02* (2013.01); *F25J 2240/40* (2013.01); *F25J 2245/02* (2013.01); *F25J 2245/90* (2013.01); *F25J 2270/04* (2013.01)

(58) Field of Classification Search
CPC .. F25J 2205/02; F25J 2270/04; F25J 2240/40; F25J 1/0037
See application file for complete search history.

(56) References Cited

U.S. PATENT DOCUMENTS 4,435,198 A * 3/1984 Gray ..... F25J 1/0022 62/622
4,638,639 A 1/1987 Marshall et al.
5,755,114 A 5/1998 Foglietta
5,916,260 A 5/1999 Dubar
6,658,890 B1 12/2003 Hahn et al.
2011/0289963 A1* 12/2011 Price ..... C10L 3/105 62/620
2013/0118204 A1* 5/2013 Higginbotham ..... F25J 1/0015 62/615
2013/0199238 A1 8/2013 Mock et al.
2013/0340472 A1* 12/2013 De Cayeux ..... F25J 1/0027 62/606

OTHER PUBLICATIONS

Invitation to Pay Additional Fees issued in connection with corresponding PCT Application No. PCT/US2017/16476 dated May 16, 2017.
International Search Report and Written Opinion issued in connection with corresponding PCT Application No. PCT/US2017/16476 dated Aug. 1, 2017.
Kennedy, D.A. et al., System and process for production of liquid natural gas, GE co-pending U.S. Appl. No. 62/210,827, filed Aug. 27, 2015.
Foglietta, Jorge, Production of LNG Using Dual Independent Expander Refrigerant Cycles, 2002, http://www.fogliettaconsulting.com/downloads/.

* cited by examiner

GAS LIQUEFACTION SYSTEMS AND METHODS

CROSS-REFERENCE TO RELATED APPLICATIONS

This application claims the benefit of priority to U.S. Provisional Application Ser. No. 62/291,868, filed on Feb. 5, 2016, and entitled "GAS LIQUEFACTION SYSTEM AND METHODS," the content of which is incorporated by reference herein in its entirety.

BACKGROUND

Liquefying natural gas can facilitate transport and storage of hydrocarbons and related material. Generally, the processes greatly reduce the volume of gas. The resulting liquid is well-suited to transit long distances, for example, by rail and road transport tankers. It is particularly economical for transport overseas and/or to areas that are not accessible by such pipeline infrastructure.

SUMMARY

The subject matter of this disclosure relates generally to systems that can liquefy an incoming hydrocarbon stream. These systems can be configured to provide cooling, typically at a heat exchanger, to closely match the cooling curve for natural gas. In this way, the system can form a liquefied natural gas (LNG) product or stream. Some systems may provide refrigeration duty by circulating a refrigerant through the heat exchanger. This "refrigeration" process is often suited for small scale LNG facilities. On the other hand, the embodiments herein can be configured for an "expander" process that circulates fluid derived from the incoming natural gas to effectuate cooling at the heat exchanger. This feature can reduce costs and complexity of the liquefaction system.

Some embodiments can be configured to circulate the "derived" fluid at an intermediate pressure that is between the pressure of the incoming hydrocarbon stream and the pressure of a stream (e.g., boil off gas) that enters from a storage facility. This feature reduces the expansion ratio so as to provide sufficient refrigeration duty with a single methane expander to liquefy the incoming feedstock and other fluids to form the LNG product. These improvements can reduce the capital costs and operational complexity of the embodiments as compared necessary to perform the liquefaction process.

Some embodiments may find use in many different types of processing facilities. These facilities may be found onshore and/or offshore. In one application, the embodiments can incorporate into and/or as part of processing facilities that reside on land, typically on (or near) shore. These processing facilities can process natural gas feedstock from production facilitates found both onshore and offshore. Offshore production facilitates use pipelines to transport feedstock extracted from gas fields and/or gas-laden oil-rich fields, often from deep sea wells, to the processing facilitates. For LNG processing, the processing facility can turn the feedstock to liquid using suitably configured refrigeration equipment or "trains." In other applications, the embodiments can incorporate into production facilities on board a ship (or like floating vessel), also known as a floating liquefied natural gas (FLNG) facility.

The subject matter herein may relate to subject matter found in U.S. Provisional Application Ser. No. 62/210,827, filed on Aug. 27, 2015, and entitled "SYSTEM AND PROCESS FOR PRODUCTION OF LIQUID NATURAL GAS," and subject matter found in U.S. Ser. No. 14/985,490, filed on Dec. 31, 2015, and entitled "GAS LIQUEFACTION SYSTEM AND METHODS."

BRIEF DESCRIPTION OF THE DRAWINGS

Reference is now made briefly to the accompanying drawings, in which.

Figure 1:
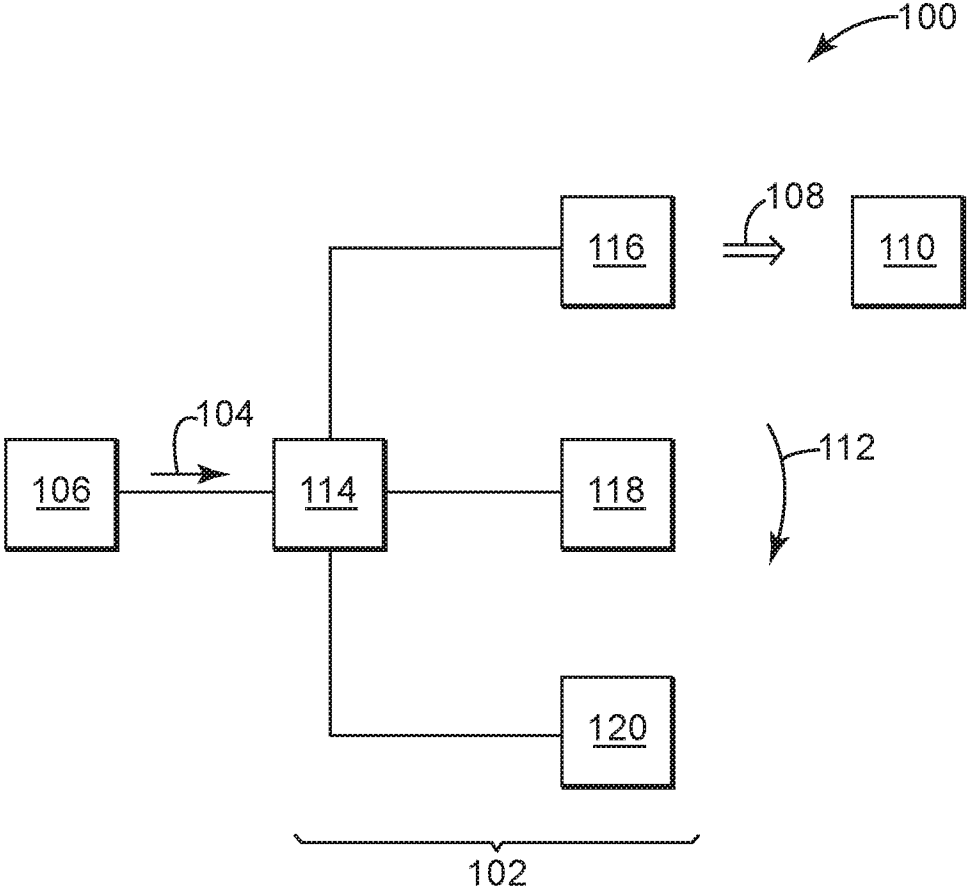
FIG. 1 depicts a schematic diagram of an exemplary embodiment of a liquefaction system.

Where applicable like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

The discussion below describes various embodiments that are useful to process hydrocarbons for storage as liquid natural gas (LNG). These embodiments include a fluid circuit that flashes and then cools the circulating hydrocarbon stream at an intermediate pressure between the "high" pressure of an incoming hydrocarbon feedstock and the "low" pressure of a boil-off gas that originates from a storage facility. Other embodiments are within the scope of the disclosed subject matter.

FIG. 1 illustrates a schematic diagram of an exemplary embodiment of a liquefaction system 100 (also, "system 100") for use to liquefy a hydrocarbon stream. At a high level, the system 100 can have a fluid circuit 102 that receives a feedstock 104 from a source 106. Incoming feedstock 104 may be in vapor form (also, "gas" or "natural gas") with a composition that is predominantly methane. Embodiments of the system 100 may be compatible with compositions having methane in a first concentration that is approximately 93% (930,000 ppmV) or greater. In use, the system 100 can form one or more products (e.g., a first product 108), typically liquid natural gas (LNG) that meets specifications that define parameters (e.g., temperature, pressure, composition, etc.) for storage. These specifications may specify a second concentration of methane for the LNG product 108 that is lower than the first concentration of incoming feedstock 104. In one example, the second concentration of methane in the first product 108 for may be approximately 99% or more (990,000 ppmV). The fluid circuit 102 can distribute the LNG product 108 to a storage facility 110 and/or other collateral process equipment.

The fluid circuit 102 may be configured to form and circulate fluids (e.g., gasses and liquids). For clarity, these fluids are identified in FIG. 1 as a process stream 112. In one implementation, the fluid circuit 102 may include a first heat exchanger 114 (also, "main heat exchanger 114"). Examples of the main heat exchanger 114 can have multiple passes, each in the form of a passage that may include brazed aluminum fins ("plate-fin exchanger") and/or tubular coils ("coil wound exchanger"). Such configurations can facilitate indirect exchange of thermal energy among the fluids that pass through the main heat exchanger 114. The passages can couple with or more processing units to exchange the process stream 112 at various temperatures. Examples of the process stream 112 can be in vapor, liquid, and mixed-phase forms. However, in one implementation, the fluid circuit 102 may be configured to maintain the process stream 112 in a single phase, either vapor phase or liquid phase. The processing units can be arranged as a sub-cooling unit 116, a compression unit 118, and methane expander 120.

Figure 2:
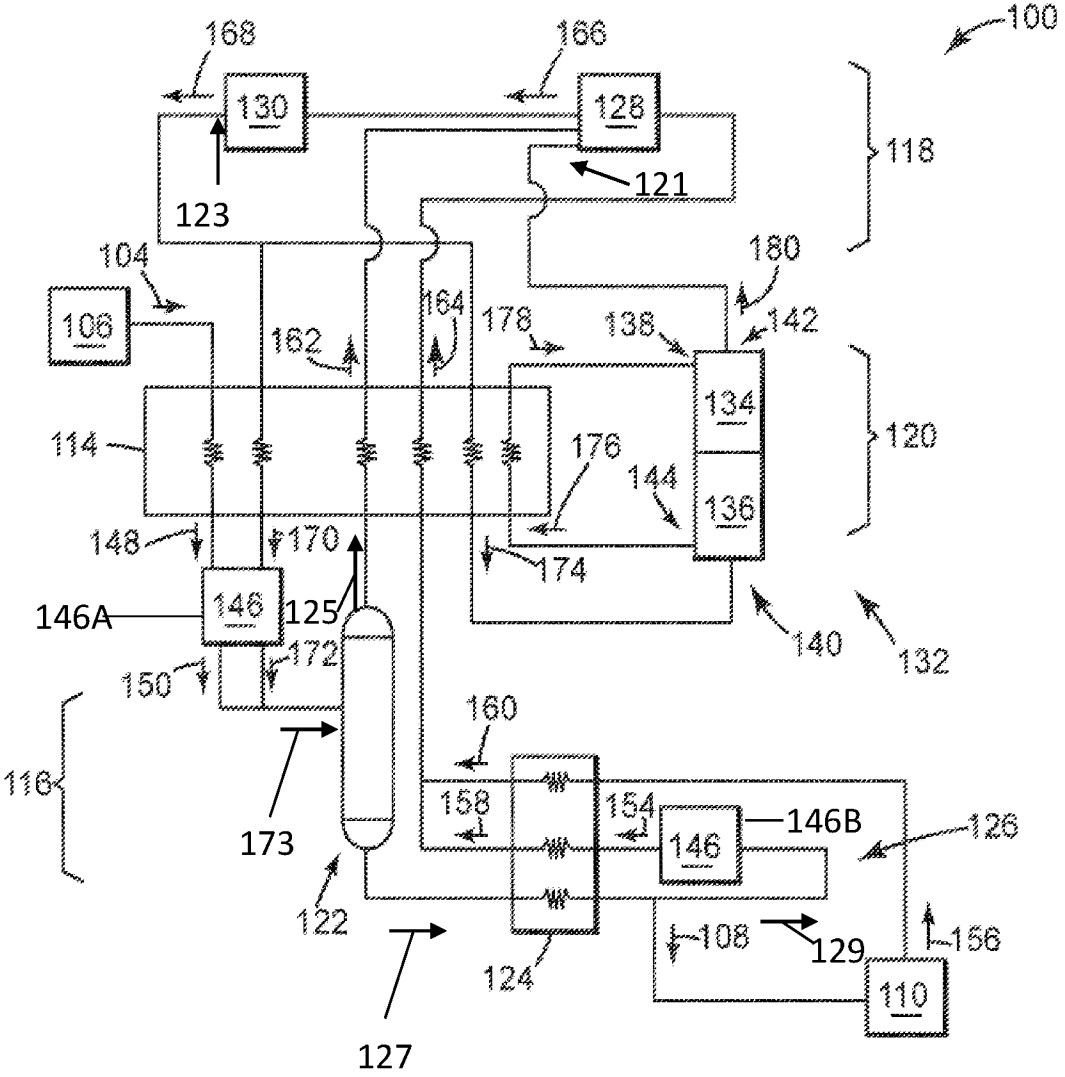
FIG. 2 depicts a schematic diagram of an example of components to implement the liquefaction system of FIG. 1.

FIG. 2 illustrates an example of components to implement the liquefaction system 100 that renders the LNG product 108 from incoming feedstock 104. At the sub-cooling unit 116, the fluid circuit 102 can have a first vessel 122 that couples with a second heat exchanger 124. Examples of the second heat exchanger 124 can form three passes, although fewer or more passes may be useful in certain implementations of the system 100. The fluid circuit 102 can form a fluid path 126 that couples the passes of the second heat exchanger 124 together. In the compression unit 118, the fluid circuit 102 can incorporate one or more compression circuits (e.g., a first compression circuit 128 and a second compression circuit 130), referred to collectively as the "recycle gas compression circuit." The first compression circuit 128 can couple with the sub-cooling unit 116 via the main heat exchanger 114. The methane expander 120 can be part of an open loop circuit or "recycle gas circuit" that provides the primary refrigeration at the main heat exchanger 114. This recycle gas circuit can include a turbo-machine 132, preferably having a turbo-compressor 134 that is configured to operate in response to work from a turbo-expander 136. The turbo-machine 132 can have a pair of inlets (e.g., a first inlet 138 and a second inlet 140) and a pair of outlets (e.g., a first outlet 142 and a second outlet 144). The inlets 138, 140 and the outlets 142, 144 couple the turbo-machine 132 with the main heat exchanger 114 and the first compression circuit 128. including first outlet 142 connected through fluid circuit 102 to compression circuit inlet 121 and compression circuit outlet 123 is connected through fluid circuit 102 to second inlet 140.

The fluid circuit 102 may benefit from one or more auxiliary or peripheral components that can facilitate processes to generate the LNG product 108. For example, the fluid circuit 102 may include one or more throttling devices 146. Examples of the throttling devices 146 can include valves (e.g., Joule-Thompson valves) and/or devices that are similarly situated to throttle the flow the process stream 112 (FIG. 1). In use, the throttling devices 146 can be interposed between components in the fluid circuit 102 as necessary to achieve certain changes in fluid parameters (e.g., temperature, pressure, etc.).

The compression circuits 128, 130 can have one or more compression stages. Two or three stages may be appropriate for many applications. The compression stages of the second compression circuit 130 may be independent or separate from the compression stages of the first compression circuit 128. This discussion does also contemplates applications for the system 100 that may benefit from combinations of the stages of compression circuits 128, 130, in whole or in part.

Starting at the left side of the diagram in FIG. 2, the fluid circuit 102 can direct the process stream 112 (FIG. 1) through the various components to generate the LNG product 108. In one implementation, incoming feedstock 104 can enter a first pass of the main heat exchanger 114 at a first pressure and a first temperature, typically ambient temperature that prevails at the system 100 and/or the surrounding facility. The first pressure may depend on operation of the facility and/or installation. Exemplary pressure may be approximately 700 psig. But this disclosure contemplates that the embodiments can be tuned to accommodate pressure in a range of approximately 400 psig to approximately 1200 psig. Incoming feedstock 104 exits the device (at 148) at a second temperature in a range from approximately −140° F. to approximately −170° F.

The fluid circuit 102 can direct the cooled fluid stream 148 to a first throttling device 146A (e.g., throttling device 146). This first throttling device 146A "flashes" the cooled fluid stream 148 upstream of the first vessel 122, effectively reducing the pressure from the first pressure to the intermediate pressure mentioned above. This intermediate pressure may correspond with suction pressure for one or more of the stages of the compression circuits 128, 130. In one example, the intermediate pressure is at or slightly above (e.g., within 10%) of suction pressure for the first compression stage of the second compression circuit 130. Flashing at this intermediate pressure is beneficial to simplify construction of the system 100. In one implementation, the cooled fluid stream 148 may exit the first throttling device (at 150) so that the intermediate pressure is less than the first pressure, for example, in a range of approximately 200 psig to approximately 250 psig and at a temperature from approximately −170° F. to approximately −200° F.

The fluid circuit 102 can direct the flashed stream 150 at the reduced pressure and, where applicable, reduced temperature to the first vessel 122. Processes in the first vessel 122 may separate flashed stream 150 at the intermediate pressure (and in mixed-phase form) into a top product 125 and a bottom product 127, one each in vapor form and liquid form, respectively. In one implementation, the fluid circuit 102 can direct the liquid bottom product 127 to a first pass of the second heat exchanger 124. This first pass further reduces the temperature of the liquid bottom product 127 so that the liquid bottom product is at (or near) the storage pressure of the storage tank at the storage facility 110. Typical "storage" pressure for the system 100 may be approximately 28 psig. But such values may depend on specifications at the storage facility 110 that can call for "storage" pressure from approximately 1 psig (or "unpressurized") to approximately 30 psig ("pressurized") or more. In one implementation, the liquid bottom product 127 exits the first pass of the second heat exchanger 124 in a range from approximately −245° F. to approximately −260° F.

The fluid circuit 102 can split the liquid bottom product into one or more portions downstream of the second heat exchanger 124. The fluid circuit 102 can direct a first portion as the LNG product 108 for storage in the storage facility 110. The fluid circuit 102 can direct a second portion 129, or "slip stream," back to a second pass of the second heat exchanger 124 via the fluid path 126. In one implementation, the fluid circuit 102 may include a second throttling device 146B (e.g., throttling device 146) interposed between the first pass and the second pass of the second heat exchanger 124. This second throttling device can be configured to flash the slip stream so that the slip stream exits the device (at 154) at a pressure that is below the "storage" pressure. This pressure can be a range of approximately 25 psig to approximately 10 psig.

The fluid circuit 102 can also couple the sub-cooling unit 116 with the storage facility 110. This configuration can direct a stream 156 to a third pass of the second heat exchanger 124. Examples of the stream 156 can include boil-off vapor from a storage tank at the storage facility 110, although the vapor may result from processing of fluids that occur at the storage facility 110.

The second pass and the third pass are useful to sub-cool the slip stream 154 and boil-off stream 156. During operation, and as noted above, each of the slip stream 154 and the boil-off stream 156 can be conditioned upstream of the second heat exchanger 124 to pressure below the "storage" pressure, e.g., of the storage tank at the storage facility 110. The slip stream 154 may exit the second pass of the second heat exchanger 124 as vapor (at 158) at a temperature from approximately −175° F. to approximately −190° F. The boil-off stream 156 may exit the third pass of the heat exchanger 124 (at 160) at a temperature of from approximately −175° F. to approximately −190° F. This fluid circuit 102 can be configured to combine the stream 158 and the stream 160 downstream of the second heat exchanger 124 and upstream of main heat exchanger 114. This combined vapor stream 158, 160 can provide additional cooling at the main heat exchanger 114, as noted more below.

The fluid circuit 102 can direct the vapor top product 125 stream from the first vessel 122 and the combined vapor stream 158, 160 from the second heat exchanger 124 to the compression unit 118. Preferably, these streams flow through separate passes of the main heat exchanger 114. In one implementation, the vapor top product 125 stream from the first vessel 122 enters a second pass of the main heat exchanger 114. This stream may be useful to provide some of the cooling duty at the main heat exchanger 114. The combined vapor stream 158, 160 from the second heat exchanger 124 enters a third pass of the main heat exchanger 114. Each of the second pass and the third pass warms the respective stream so that the streams exit the heat exchanger 114 (at 162, 164) at a temperature from approximately 90° F. to approximately 120° F.

The fluid circuit 102 can couple the passes of the main heat exchanger 114 with different locations of the first compression circuit 128. This configuration uses the stream 164 (formed by the combined vapor stream 158, 160) as make-up for the compression circuits 128, 130. In one implementation, the fluid circuit 102 can direct the stream 164 from the third pass to a first location that is upstream of each of the compression stages (e.g., of the first compression circuit 128). Vapor stream 162 from the second pass can enter at a second location, preferably at an intermediate compression stage of the recycle gas compression circuit and, in one example, downstream of each of the compressions stages of the first compression circuit 128. In one implementation, the first compression circuit 128 can be configured so that a vapor stream exits the last of the compression stages (at 166) at a pressure from approximately 200 psig to approximately 250 psig. This pressure may serve as the suction pressure for the second compression circuit 130. The fluid circuit 102 can direct the vapor stream 166 at this pressure to the second compression circuit 130. This configuration is effective to compress the vapor stream 166 so as to exit the second compression circuit 130 (at 168) at its maximum pressure. In one implementation, the maximum pressure of the vapor stream 168 is approximately 1200 psig and, in one example, from approximately 1000 psig to approximately 1200 psig.

The recycle gas compression circuit can embody an open loop circuit. This type of circuit can bleed-off a portion of the compressed vapor stream 168 that exits the second compression circuit 130. This portion finds use as the primary cooling stream for the main heat exchanger 114. During operation, bleed-off may occur after the circuit builds up from continuous feed from the first vessel 122, the second heat exchanger 124, and discharge from the turbo-compressor 134. In one implementation, the fluid circuit 102 can be configured to split the compressed vapor stream 168 to form one or more portions upstream of the main heat exchanger 114. The first portion can exit a fourth pass (at 170) as liquid at a temperature of from approximately −140° F. to approximately −170° F. The fluid circuit 102 can direct the first portion 170 from the fourth pass to the first throttling device 146. The first portion 170 may exit the first throttling device 146A (at 172) at the same pressure that the cooled fluid stream 148 exits the first throttling device 146A (at 150), preferably from approximately 200 psig to approximately 250 psig. The fluid circuit 102 can, in turn, combine these two flashed streams 150, 172 upstream of the first vessel 122 to form a mixed stream 173 that is fed into first vessel 122.

The second portion forms the primary cooling stream of the recycle gas circuit. As shown in FIG. 2, this second portion can exit a fifth pass (at 174) at a temperature of from approximately 20° F. to approximately 0° F. and, in one example, at approximately 13° F. and. The fluid circuit 102 can direct the cooled second portion 174 from the fifth pass to the inlet 140 of the turbo-expander 136. In one implementation, the turbo-expander 136 can be configured to decrease the pressure of the cooled second portion 174. This apparatus may operate so that the vapor stream exits the turbo-expander 136 (at 176) at a pressure from approximately 110 psig to approximately 130 psig and, in one example, the pressure is approximately 116 psig. Expansion at the turbo-expander 136 can result in the expanded vapor stream 176 having a temperature of −116° F., but this temperature can vary from approximately −180° F. to approximately −150° F. The fluid circuit 102 can direct the expanded vapor stream 176 to a sixth pass of the main heat exchanger 114. As noted above, flow of the expanded vapor stream 176 through this sixth pass can provide the primary refrigeration for the main heat exchanger 114. The expanded vapor stream can exit the sixth pass (at 178) at a temperature from approximately 90° F. to approximately 120° F. As shown in FIG. 2, the fluid circuit 102 can direct the resulting liquid stream 178 from the sixth pass to the inlet 138 of the turbo-compressor 134, which compresses the incoming fluid. In one implementation, the liquid stream 178 may exit the turbo-compressor 134 (at 180) at a pressure from approximately 200 psig to approximately 300 psig. The fluid circuit 102 can be configured to return the stream 180 to the second location on the compression unit 118.

Figure 3:
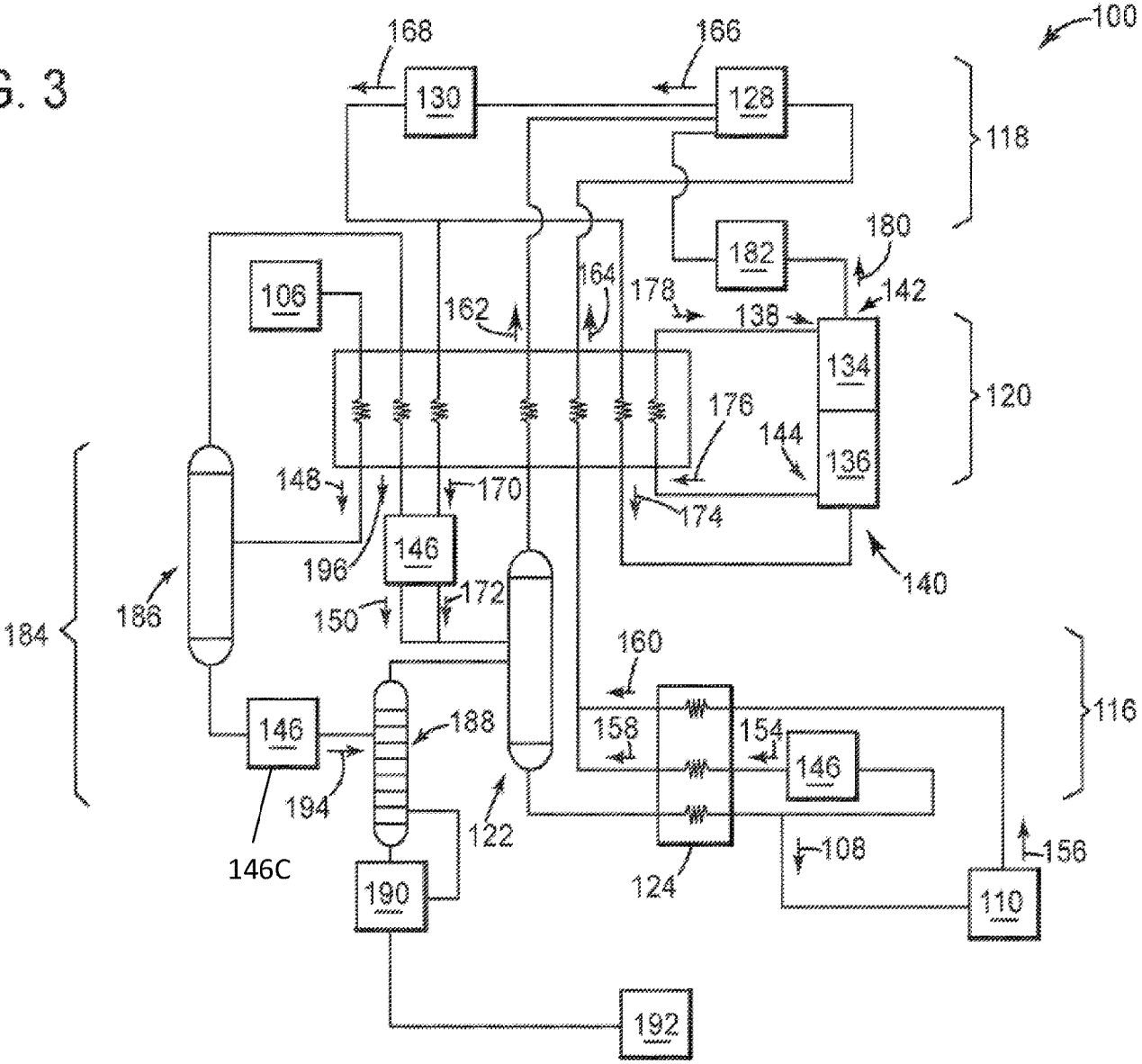
FIG. 3 depicts a schematic diagram of an example of components to implement the liquefaction system of FIG. 1.

FIG. 3 depicts an example of additional components that may be helpful to implement the liquefaction system 100. The fluid circuit 102 may include a cooler 182 interposed between the first compression circuit 128 and the turbo-compressor 134. The fluid circuit 102 may also include a separation unit 184 to remove impurities (e.g., heavy hydrocarbons) from incoming feedstock 104. Examples of the separation unit 184 may include a pair of vessels (e.g., a second vessel 186 and a third vessel 188). Processes that occur at the vessels 186, 188 can form a top product and a bottom product in vapor form and liquid form, respectively.

The third vessel 188 may also benefit from use of one or more peripheral components (e.g., a peripheral component 190). Examples of the peripheral component 190 can include pumps, boilers, heaters, and like devices that can facilitate operation of one or more of the vessels 186, 188. In one implementation, the peripheral component 190 may embody a boiler that couples the third vessel 186 with a pipeline 192 and/or like collateral equipment (e.g., conduit, tank, etc.).

The fluid circuit 102 may be configured with the cooler 182 between the second location on the compression circuits 128, 130 and the turbo-compressor 134. This configuration is useful to cool the stream 180 that exits the turbo-compressor 134. In one implementation, the stream 180 exist the cooler 182 so as to enter the second location of the compression unit 118 at a temperature of approximately 111° F. However, this temperature may vary within in a range from approximately 90° F. to approximately 120° F.

The fluid circuit 102 may be configured to couple the main heat exchanger 114 with the separation unit 184. This configuration can direct the stream 148 from the first pass to the second vessel 186. Depending on the composition of incoming feedstock 104 (and, correspondingly, the stream 148), the second vessel 186 can operate at pressure that is less than 700 psig, although this operating pressure can vary in a range of from approximately 600 psig to approximately 800 psig. In one implementation, the second vessel 186 operates at parameters (e.g., temperature, pressure, etc.) so that the vapor top product meets specifications that define the composition of the LNG product 108.

The fluid circuit 102 can direct the liquid bottom product from the second vessel 186 to the third vessel 188. Examples of the third vessel 188 can operate as a stabilizer column to remove light hydrocarbons to form a liquid bottom product that is "stable" for storage. This liquid bottom product may be a liquid petroleum (LPG) product stabilized at propane vapor pressure. Operating parameters for the third vessel 188 may designate a pressure equal to or slightly above the operating pressure of the first vessel 122. A third throttling device 146C (e.g., throttling device 146) may be useful to reduce the pressure and/or temperature of the liquid bottom product upstream of the third vessel 188. In one implementation, the third vessel 188 operates at parameters (e.g., temperature, pressure, etc.) so that the vapor top product meets specifications that define the composition of the LNG product 108. The liquid bottom product can exit the third throttling device 146 (at 194) at a pressure from approximately 200 psig to approximately 300 psig and a temperature of from approximately −90° F. to approximately −120° F. The fluid circuit 102 can be configured to direct the vapor top product from the stabilizer column 188 to the first vessel 122.

The stabilizer column 188 can be fabricated from standard pipe size and schedule for use with a wide range of output rates. In one example, the stabilizer column can use twelve trays so that the top vapor product meets specifications for the LNG product 108. The fluid circuit 102 may include a condenser, but such configuration may not be necessary because the incoming feedstock 110 may enter the stabilizer column at less than approximately −100° F. and the vapor top product may exit the stabilizer column at −30° F. or warmer. The boiler 190 can use either hot oil or electricity to generate heat. For small re-boiler loads, an electric re-boiler may be cost effective for this purpose.

As noted above, the vapor top products from the vessels 186, 188 can have a composition that meets specifications that define the composition for the LNG product 108. The vapor top product from the stabilizer column 188 may enter the second vessel 122. The fluid circuit 102 can direct the vapor top product from the second vessel 186 to the main heat exchanger 114. In one implementation, the vapor top product from the second vessel 186 exits (at 196) a seventh pass as a liquid at a temperature in a range from approximately −175° F. to approximately −190° F.

Figure 4:
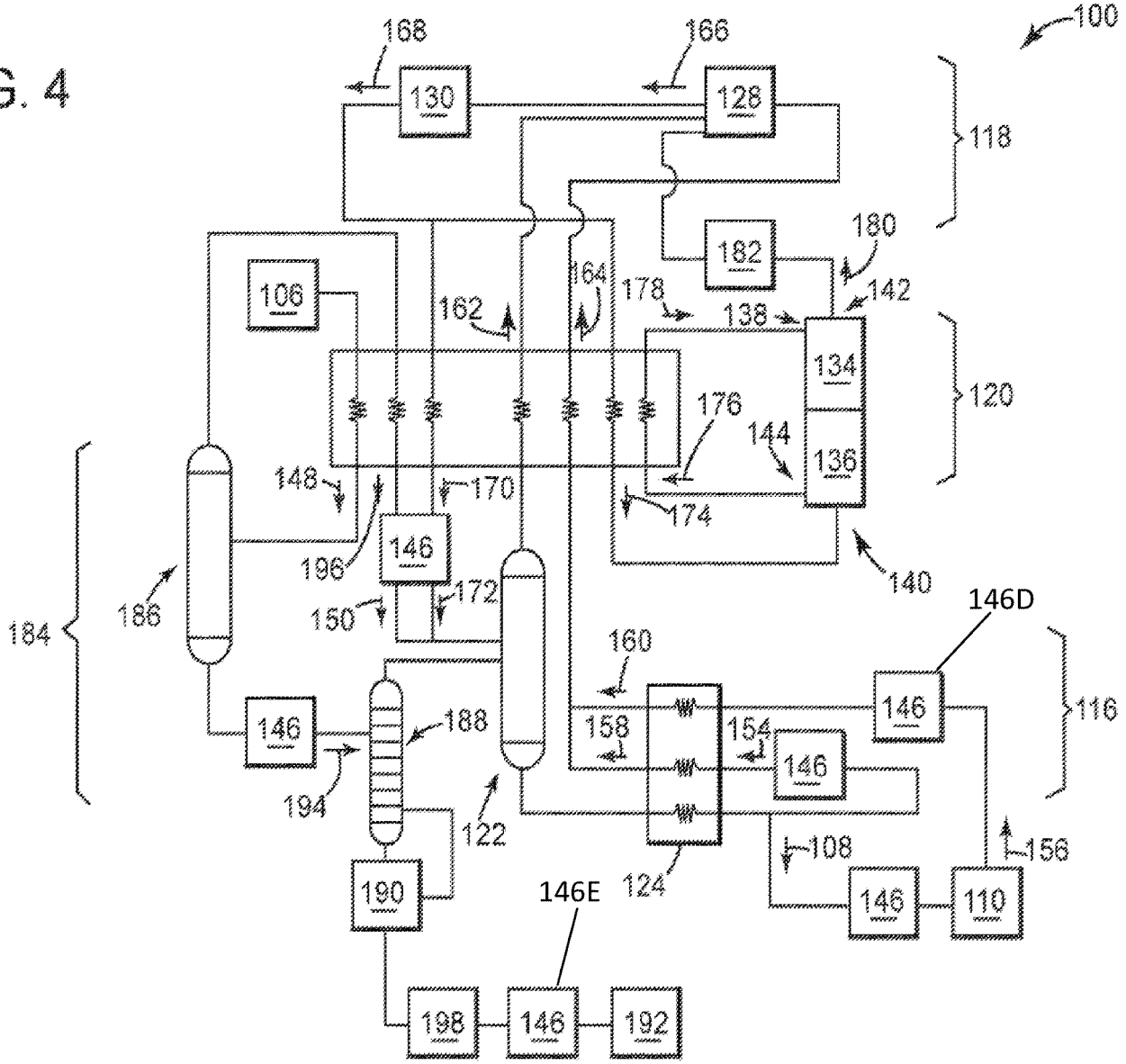
FIG. 4 depicts a schematic diagram of an example of components to implement the liquefaction system of FIG. 1.

FIG. 4 depicts an example of the system 100 with components that might be useful to condition the LNG product 108, the boil-off vapor 156, and the LPG product. One or more of these components may be part of the fluid circuit 102 or found separately as part of, for example, the storage facility 110, processing facility, and the like. The components may include additional throttling devices 146D and 146E (e.g., throttling device 146) and coolers, although this disclosure does not require nor foreclose other devices that may be useful to condition fluids as contemplated herein. For example, a fourth throttling device may reduce the pressure of the LNG product 108 downstream of the second heat exchanger 124 and upstream of the storage facility 110. A fifth throttling device may be used to condition the boil-off vapor 156 to a pressure approximately equal to the pressure of the slip stream (discussed above in connection with the sub-cooling unit 116). In one example, a cooler 198 and a sixth throttling device may condition the LPG product downstream of the stabilizer column 188.

Figure 5:
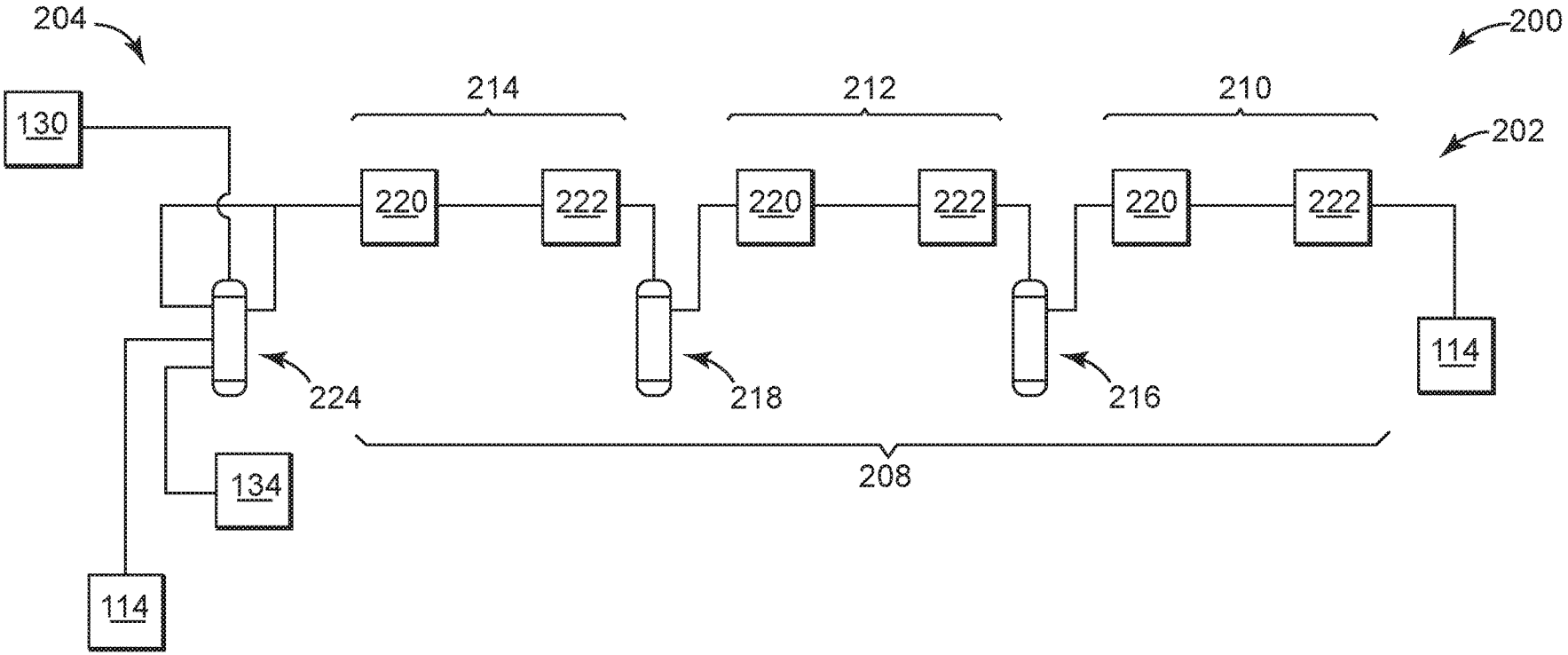
FIG. 5 depicts a schematic diagram of an example of a compression circuit for use in the liquefaction system of FIGS. 1, 2, 3, and 4.

FIG. 5 depicts an example of a compression circuit 200. This example may find use to implement the compression circuit 128 (FIGS. 2, 3, and 4). The compression circuit 200 has a first end 202 and a second end 204. The first end 202 can couple with the main heat exchanger 114, preferably to the third pass to receive the combined vapor stream that may originate from the sub-cooling unit 116. The second end 204 may couple with the second compression unit 130, with the main heat exchanger 114, as well as with the turbo-compressor 134 via, in one example, the cooler 182.

The compression circuit 200 may be configured to increase the pressure without increasing the temperature of the process stream 112 (FIG. 1) from the first end 202 to the second end 204. This functionality may be embodied in various components (e.g., coolers, compressors, etc.). In one implementation, the compression circuit 200 may include a first compression vessel 206 at the first end 202 (or "inlet"). Examples of the vessel 206 can embody a desuperheater or like device to reduce the temperature of incoming gas to make it less superheated. This device can couple with a compression path 208 that has one or more compression stages (e.g., a first stage 210, a second stage 212, and a third stage 214). The compression path 208 may include one or more compression vessels (e.g., a second compression vessel 216 and a third compression vessel 218) interposed between the stages 210, 212. Nominally, each stage may include a cooler 220 and a compressor 222. Examples of the cooler 220 may be air-cooled, although this disclosure does not limit selection to any particular type or variation for these devices. The compressor 222 may be gas, motor, and turbine driven devices that can maintain and/or raise the pressure of process stream 112 (FIG. 1) noted herein. At the second end 204, the compression path 208 may include a fourth compression vessel 224. This device can receive the compressed stream from the third stage 220. In one implementation, the fourth compression vessel 224 can also receive each of the vapor top product from the first vessel 122 (FIGS. 2, 3, and 4) and the compressed vapor stream from the turbo-compressor 134 (FIGS. 2, 3, and 4). The compression circuit 200 can deliver the vapor top product from the fourth compression vessel 224 to the second compression circuit 130.

Figure 6:
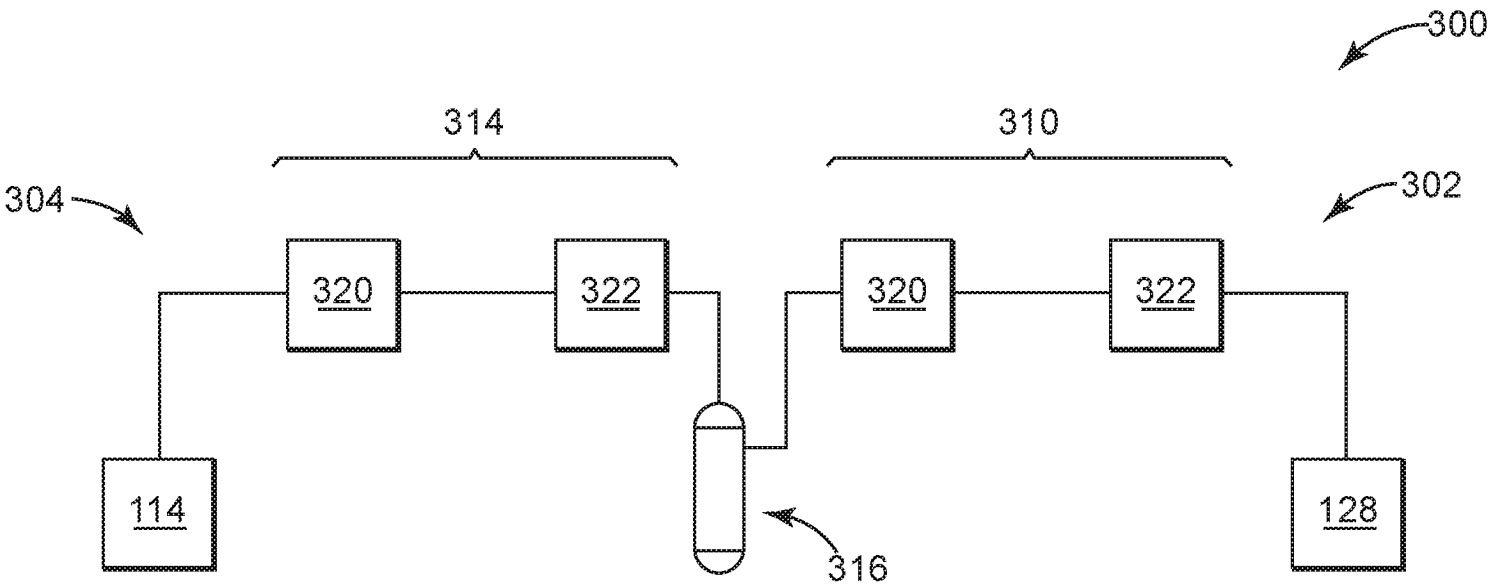
FIG. 6 depicts a schematic diagram of an example of a compression circuit for use in the liquefaction system of FIGS. 1, 2, 3, and 4.

FIG. 6 depicts an example of a compression circuit 300. This example may find use to implement the compression circuit 130 (FIGS. 2, 3, and 4). The first end 302 can couple with the first compression circuit 128; as noted above, the compression circuit 118 may be configured to direct the vapor top product from the fourth compression vessel 224 to the first stage 310. At the second end 302, the compression circuit 300 can couple with the main heat exchanger 114, preferably to the fourth pass to deliver compressed vapor stream to the first throttling device.

Figure 7:
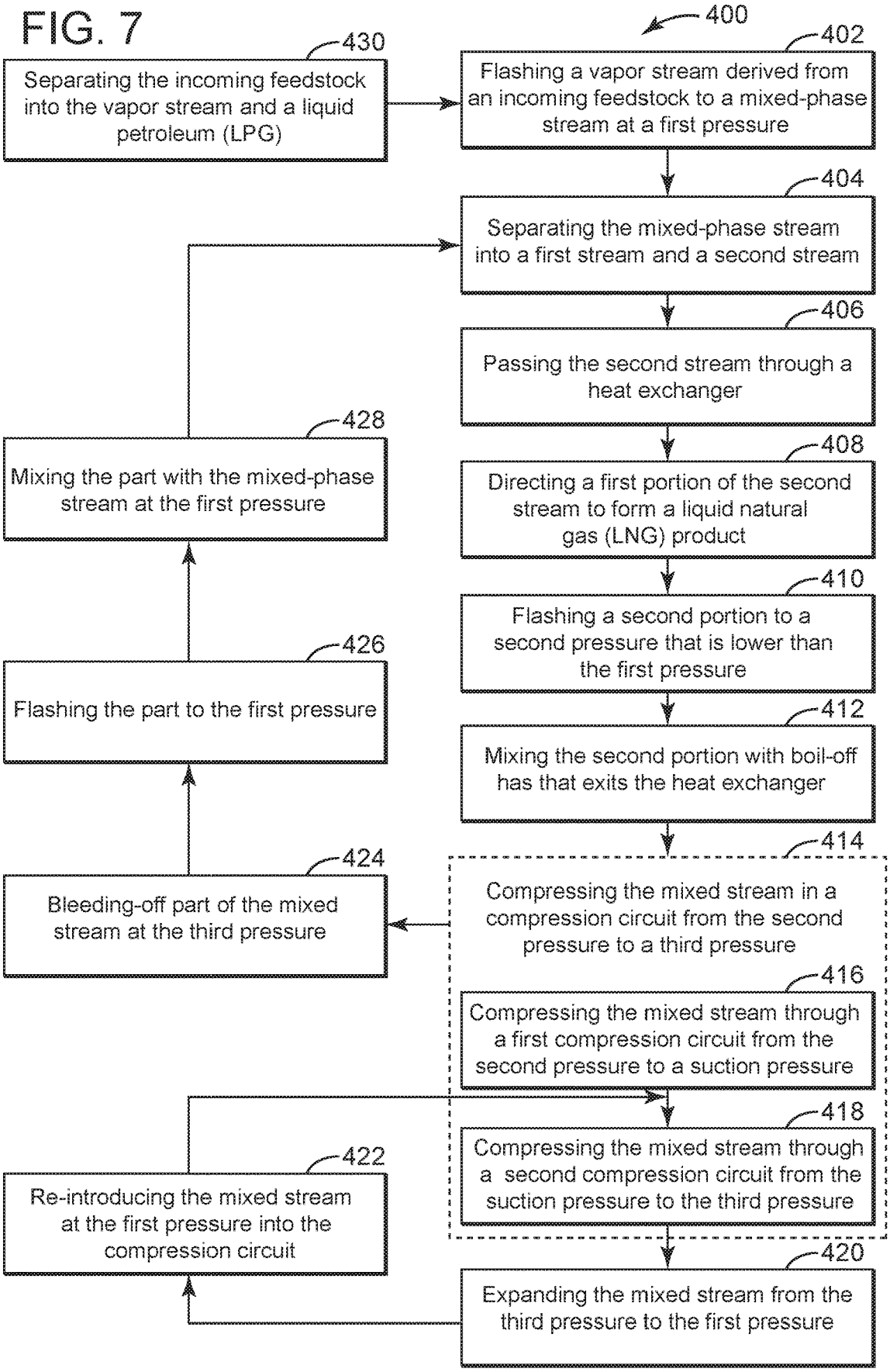
FIG. 7 depicts a flow diagram of an exemplary embodiment of a liquefaction process.

FIG. 7 depicts an example of a process 400 to liquefy an incoming natural gas stream. The process 400 may leverage the structure discussed above in whole or in part. In one implementation, the process 400 may include, at stage 402, flashing a vapor stream derived from an incoming feedstock 104 to a mixed-phase stream 173 at a first pressure and, at stage 404, separating the mixed-phase stream 173 into a first stream 125 and a second stream 127. The process 400 may also include, at stage 406, passing the second stream 127 though a heat exchanger and, at stage 408, directing a first portion 108 of the second stream to form a liquid natural gas (LNG) product. The process 400 may include, at stage 410, flashing the second portion 129 to a second pressure that is lower that the first pressure. As noted herein, this second pressure may correspond with storage pressure of boil-off gas from a storage facility so that the process 400 may include, at stage 412, mixing the second portion 129 with boil-off gas 156 that exits the heat exchanger. In one implementation, the process 400 may include, at stage 414, compressing the mixed stream 164 in a compression circuit 118 from the second pressure to a third pressure. This stage may include, at stage 416, compressing the mixed stream 164 through a first compression circuit 128 from the second pressure to a suction pressure and, at stage 418, compressing the mixed stream through a second compression circuit 130 from the suction pressure to the third pressure. The process 400 may further include, at stage 420, expanding the mixed stream 136 from the third pressure to the first pressure and, at stage 422, re-introducing the mixed stream 180 at the first pressure into the compression circuit 118. In one implementation, the process 400 may include, at stage 424, bleeding off part of the mixed stream 168 at the third pressure, at stage 426, flashing the part 170 to the first pressure, and at stage 428, mixing the part 172 with 150 to form the mixed phase stream 173 at the first pressure before separating the mixed-phase stream into the first stream 125 and the second stream 127 (at stage 404). Further, the process 400 may include, at stage 430, separating the incoming feed stock 184 into the vapor stream and a liquid petroleum (LPG) product prior to flashing (at stage 402).

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the embodiments, including the best mode, and also to enable any person skilled in the art to practice the embodiments, including making and using any devices or systems and performing any incorporated methods. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In view of the foregoing, some embodiments exhibit process efficiency that compares favorably with a nitrogen expander process but require more horsepower than an equivalent sized mixed refrigerant system as well as pressurized storage. Some embodiments require only a single expander to achieve these improvements. This requirement compares favorably with systems that employ two expanders that work in parallel. Moreover, unlike systems that implement mixed-refrigeration processes, some embodiments do not require refrigerants, thus eliminating the need for use, handling, and on-site storage of refrigerants. In this regard, the examples below include certain elements or clauses one or more of which may be combined with other elements and clauses describe embodiments contemplated within the scope and spirit of this disclosure.

What is claimed is:

1. A liquefaction process, comprising:

receiving, by a first pass of a first heat exchanger, an incoming feedstock;

outputting, from the first pass of the first heat exchanger, a vapor stream derived from the incoming feedstock;

flashing the vapor stream derived from the incoming feedstock to a mixed-phase stream at a first pressure;

separating the mixed-phase stream into a first stream and a second stream;

passing the second stream through a second heat exchanger;

splitting the second stream downstream from the second heat exchanger into a first portion and a second portion;

directing the first portion of the second stream as a liquid natural gas (LNG) product to a storage facility;

mixing a second portion of the second stream with a boil-off gas that exits the storage facility to form a mixed stream;

introducing the mixed stream into a compression unit, the compression unit comprising a first compression circuit and a second compression circuit, each of the first and second compression circuits including a compressor;

compressing the mixed stream from the second pressure to a third pressure;

expanding the mixed stream from the third pressure to the first pressure; and re-introducing the mixed stream at the first pressure into the compression unit, wherein the first pressure corresponds with suction pressure internal to the compression unit.

2. The liquefaction process of claim 1, further comprising:

compressing the mixed stream through the first compression circuit from the second pressure to suction pressure for the second compression circuit downstream of the first compression circuit.

3. The liquefaction process of claim 2, further comprising:

compressing the mixed stream through the second compression circuit from the suction pressure to the third pressure.

4. The liquefaction process of claim 1, further comprising:

bleeding-off part of the mixed stream at the third pressure; and mixing the part with the mixed-phase stream at the first pressure.

5. The liquefaction process of claim 4, further comprising:
flashing the part of the mixed stream to the first pressure.

* * * * *